US007226397B1

(12) United States Patent
MacDonald et al.

(10) Patent No.: US 7,226,397 B1
(45) Date of Patent: Jun. 5, 2007

(54) ROWING EXERCISE MACHINE

(75) Inventors: Douglas B. MacDonald, Des Plaines, IL (US); Zhi Lu, West Dundee, IL (US); Mark C. Termion, Winfield, IL (US); Eric C. White, Streamwood, IL (US)

(73) Assignee: Brunswick Corporation, Lake Forest, IL (US)

( * ) Notice: Subject to any disclaimer, the term of this patent is extended or adjusted under 35 U.S.C. 154(b) by 414 days.

(21) Appl. No.: 10/973,504

(22) Filed: Oct. 26, 2004

Related U.S. Application Data

(63) Continuation-in-part of application No. 10/894,936, filed on Jul. 20, 2004.

(51) Int. Cl.
*A63B 69/06* (2006.01)
*A63B 21/045* (2006.01)

(52) U.S. Cl. ..... 482/72; 482/114; 482/127

(58) Field of Classification Search ..... 482/114–116, 482/127, 129, 130, 133, 135, 72, 73
See application file for complete search history.

(56) References Cited

U.S. PATENT DOCUMENTS

| | | | | |
|---|---|---|---|---|
| 3,124,342 | A | 3/1964 | Ormond | |
| 3,167,312 | A | 1/1965 | Blanchard | |
| 3,752,475 | A | 8/1973 | Ott | |
| 4,721,930 | A | 1/1988 | Cohen | |
| 4,746,113 | A | 5/1988 | Kissel | |
| 4,753,434 | A | 6/1988 | Salvino | |
| 4,798,378 | A * | 1/1989 | Jones | 482/72 |
| 4,909,505 | A | 3/1990 | Tee | |
| 4,911,437 | A | 3/1990 | Schulkin | |
| 5,041,060 | A | 8/1991 | Hendershot | |
| 5,046,727 | A | 9/1991 | Wilkinson et al. | |
| 5,062,619 | A | 11/1991 | Sato | |
| 5,209,461 | A | 5/1993 | Whightsil, Sr. | |
| 5,273,507 | A | 12/1993 | Sivula | |
| 5,611,524 | A | 3/1997 | Gordon | |
| 5,632,710 | A | 5/1997 | England et al. | |
| 5,705,322 | A * | 1/1998 | West et al. | 430/325 |
| 6,241,224 | B1 | 6/2001 | Leibman | |
| 6,368,259 | B1 | 4/2002 | Liao et al. | |
| 6,440,044 | B1 * | 8/2002 | Francis et al. | 482/114 |
| 6,482,139 | B1 | 11/2002 | Haag | |
| 6,761,670 | B2 * | 7/2004 | Liou | 482/72 |
| 2002/0025891 | A1 | 2/2002 | Colosky, Jr. et al. | |
| 2003/0203796 | A1 | 10/2003 | Yu | |

FOREIGN PATENT DOCUMENTS

| | | |
|---|---|---|
| JP | 09215772 | 8/1997 |

* cited by examiner

*Primary Examiner*—Stephen R. Crow
*Assistant Examiner*—Allana Lewin
(74) *Attorney, Agent, or Firm*—Andrus, Sceales, Starke & Sawall, LLP

(57) ABSTRACT

A rowing exercise machine includes a resistance mechanism having a first coupling between first and second spaced disks and resiliently deformable and tensionable in a spiral therebetween to resist rotation, and a second coupling between one of the disks and a user handle to resist movement of the handle and concordant movement of the user on a seat along a track.

35 Claims, 6 Drawing Sheets

ROWING EXERCISE MACHINE

CROSS-REFERENCE TO A RELATED APPLICATION

This application is a continuation-in-part of U.S. patent application Ser. No. 10/894,936, filed Jul. 20, 2004.

BACKGROUND AND SUMMARY

The invention relates to rowing exercise machines.

Rowing exercise machines are known in the prior art. The present invention provides a simple and effective rowing exercise machine, including incorporation of a simple effective resistance mechanism replacing resistive brakes typically used in the prior art.

BRIEF DESCRIPTION OF THE DRAWINGS PARENT APPLICATION

PRESENT INVENTION

Figure 8:
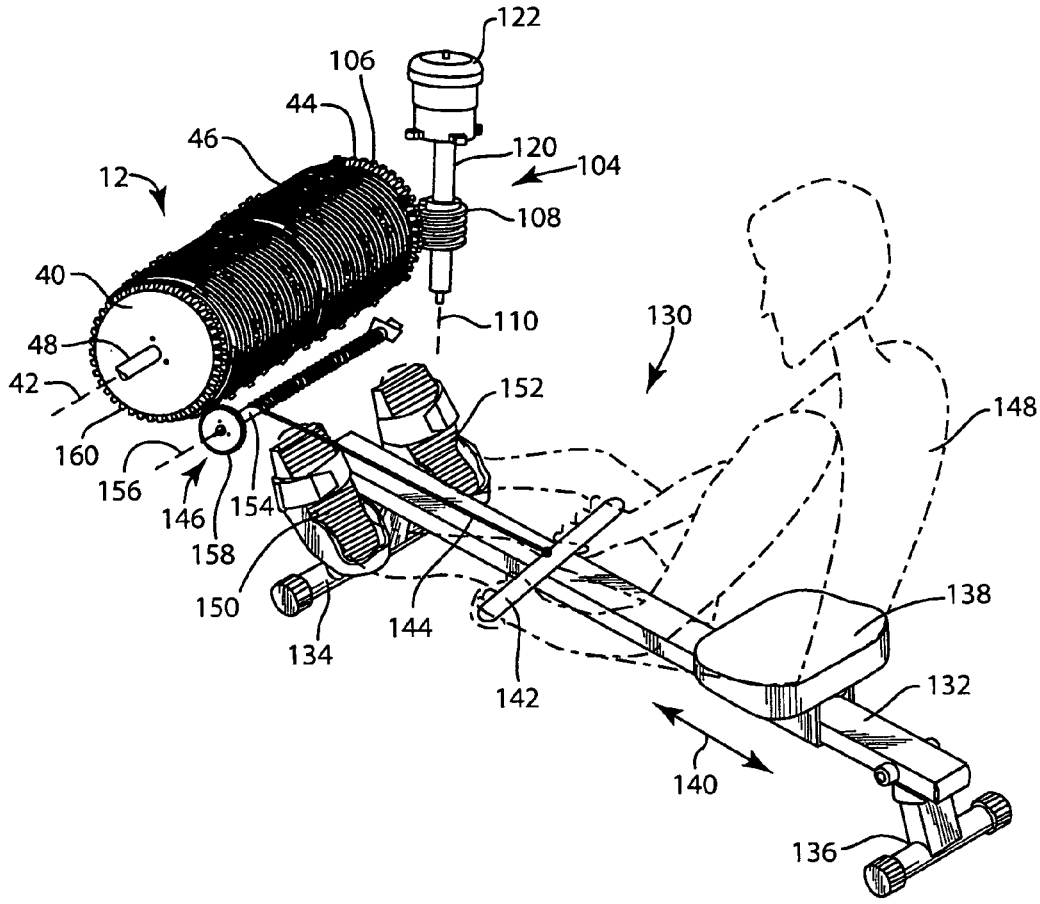

FIG. 8 is a perspective view of one form of a rowing exercise machine in accordance with the present invention.

DETAILED DESCRIPTION PARENT APPLICATION

The following description of FIGS. 1–7 is taken from the noted parent application.

Figure 1:
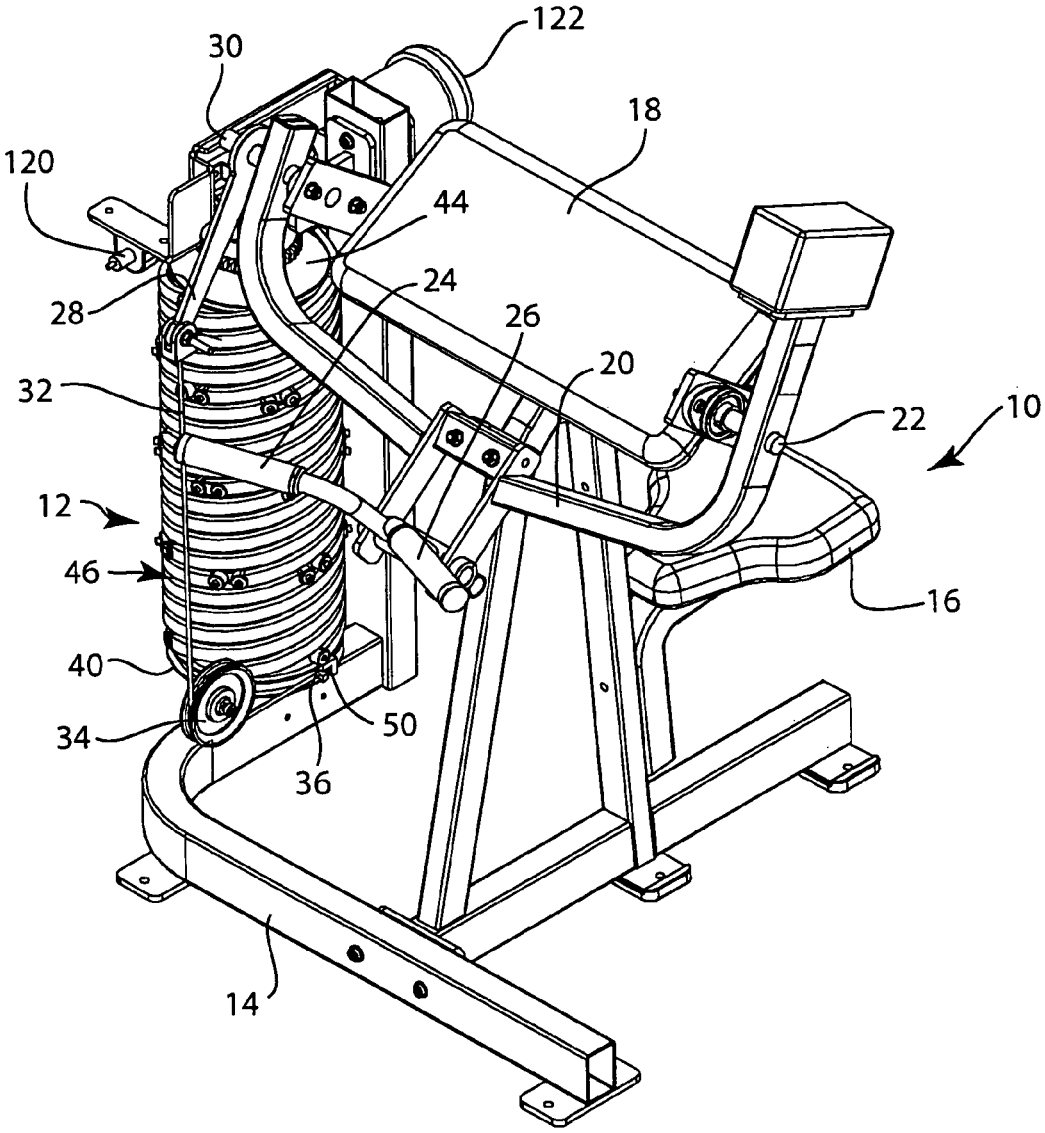
FIG. 1 is taken from FIG. 1 of the noted parent application, and is a perspective view of one form of exercise apparatus in accordance therewith.

FIG. 1 shows one form of exercise apparatus 10 having a resistance mechanism 12. The exercise apparatus shown is a seated arm curl machine having a frame 14 resting on the floor and supporting a seat 16 for the user, an upper arm pad 18, an arm bar 20 pivoted about axis 22 and having grip handles 24, 26 for gripping by the user for an upward pulling curling motion in an arc about axis 22, all as is known. A lever 28, or alternatively an eccentric cam, is fixed to arm 20 and/or pivot rod or axle 30 along axis 22 and pivots with arm 20 to pull cable 32 upwardly, which cable is trained around pulley 34 and is connected at cable end 36 to resistance mechanism 12. Various resistance mechanisms are known in the prior art for resisting movement of the cable, to provide strength training, including cardiovascular training/exercise, such as weight stacks and various biasing mechanisms. Resistance mechanism 12 may be used with various types of exercise apparatus for resistance training, including cardiovascular training/exercise. The arm curl machine is exemplary only.

Figure 2:
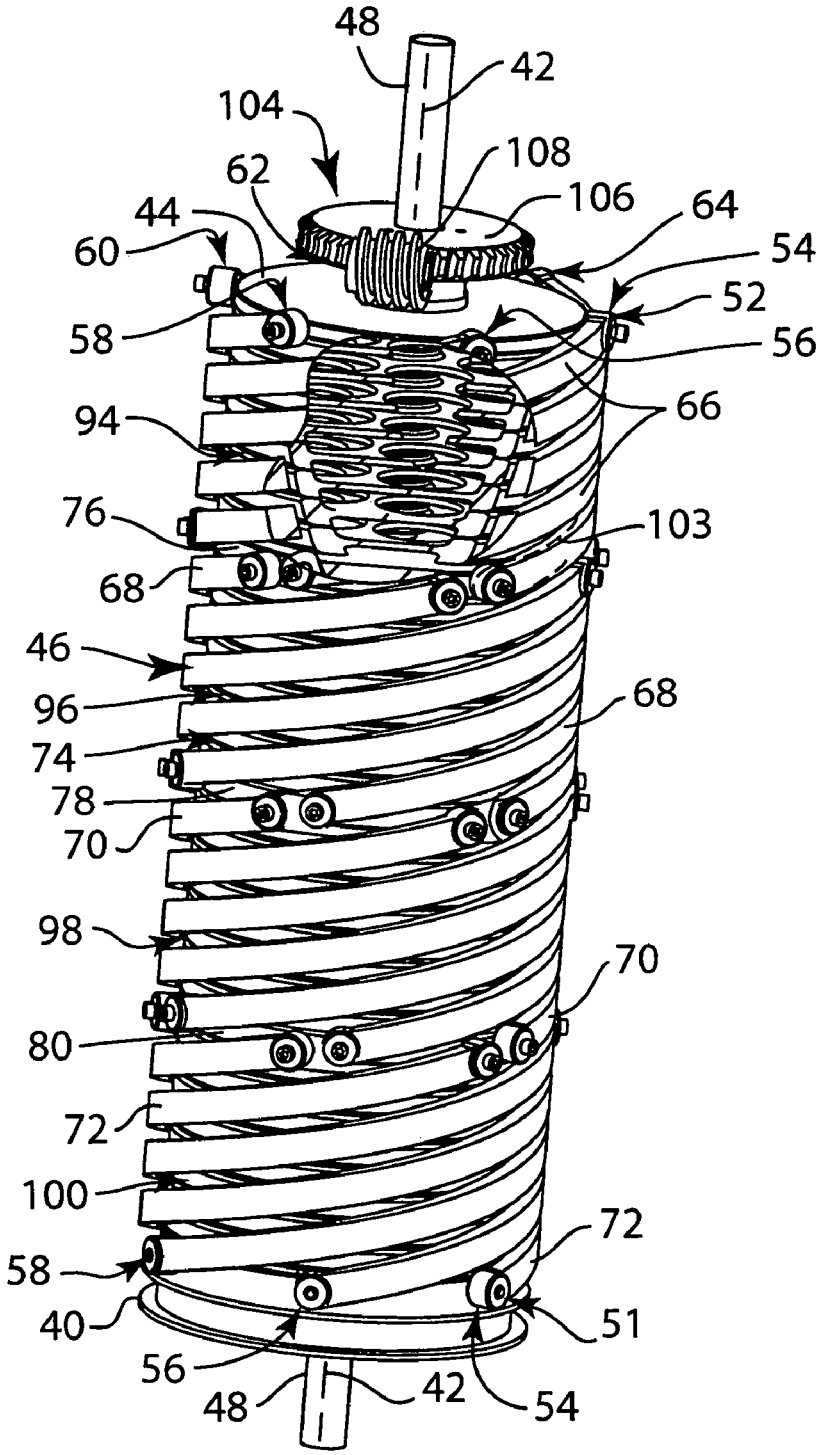
FIG. 2 is an enlarged perspective view of a portion of FIG. 1 showing the resistance mechanism.
Figure 3:
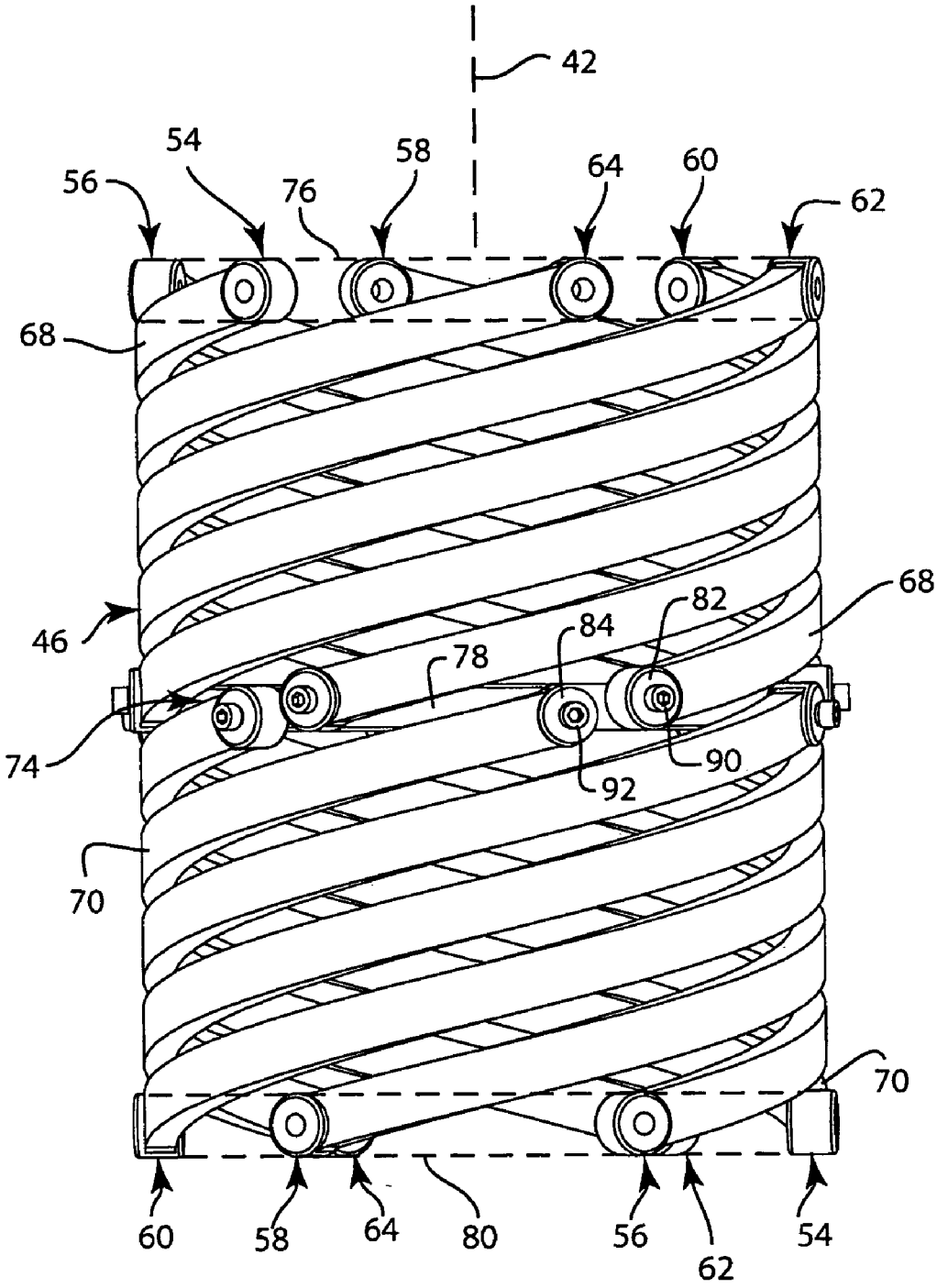
FIG. 3 is an enlarged perspective view of a portion of FIG. 2.
Figure 4:
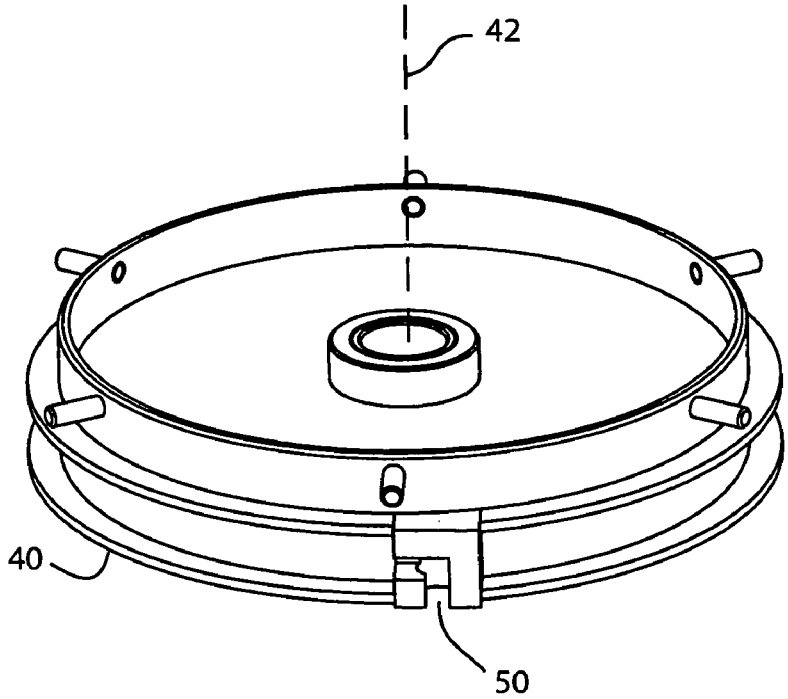
FIG. 4 is a perspective view of a component of FIG. 2.
Figure 5:
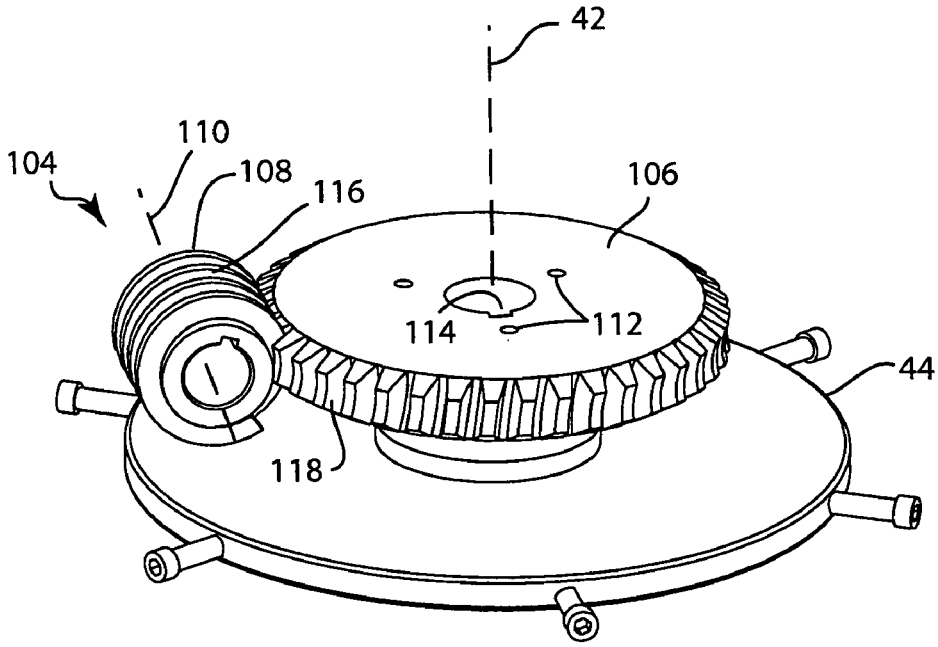
FIG. 5 is a perspective view of a component of FIG. 2.
Figure 6:
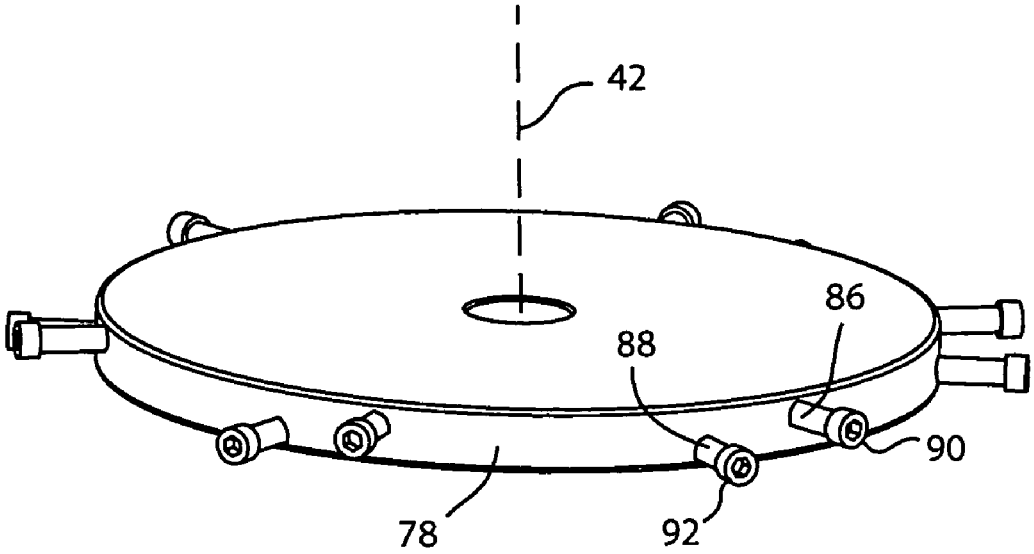
FIG. 6 is a perspective view of a component of FIG. 2.
Figure 7:
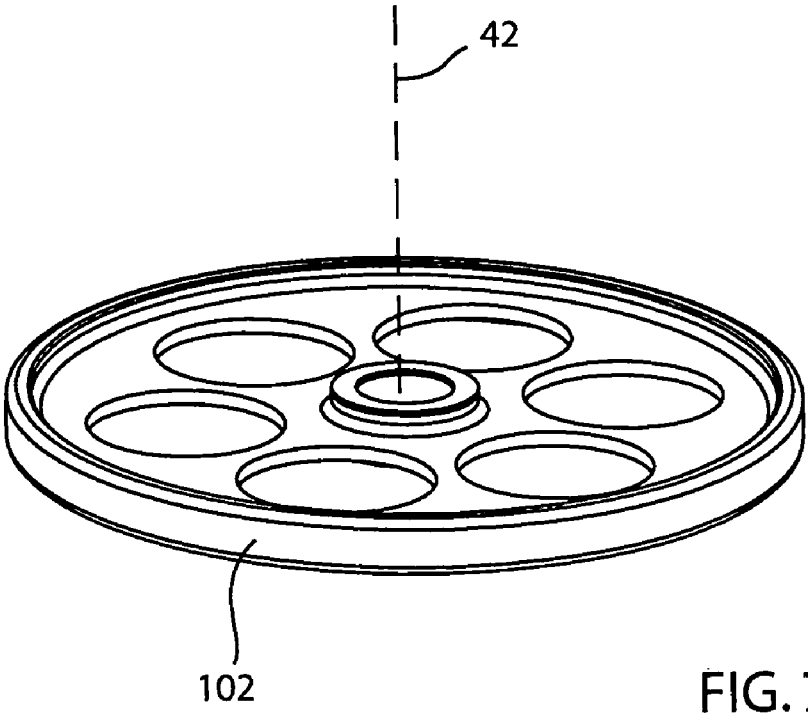
FIG. 7 is a perspective view of a component of FIG. 2.

Resistance mechanism 12 of the exercise apparatus includes a first disk 40, FIGS. 1, 2, 4, rotational about an axis 42, a second disk 44, FIGS. 1, 2, 5, axially aligned with first disk 40 and resisting rotation about axis 42, and a resiliently deformable coupling 46 coupled between disks 40 and 44 and tensionable in a spiral about axis 42 upon rotation of disk 40 about axis 42, such that rotation of first disk 40 about axis 42 tensions and stretches coupling 46 along the noted spiral and is resisted by second disk 44. In the preferred embodiment, each of disks 40 and 44, and a plurality of intermediate disks therebetween, to be described, are mounted on a common axially extending shaft 48 extending longitudinally along axis 42 and supported on frame 14. In other embodiments, each of disks 40 and 44 is mounted on its own separate shaft, and such intermediate disks are merely nested within each other along a virtual shaft, to be described. The various disks are preferably round, but may have other shapes. Cable end 36 is retained in slot or cavity 50 in disk 40 such that the latter is linked by cable 32, pulley 34 and lever 28 to arm 20 of the training member, such that movement of training member arm 20 by the user in the noted arc about axis 22 rotates disk 40 about axis 42 tensioning and stretching coupling 46 along the noted spiral which is resisted by disk 44. Disk 44 has a fixed, or at least resistive, rotational position about axis 42, to be described. In the rest position, coupling 46 may or may not be in a spiral.

Coupling 46 has a first end 51, FIG. 2, coupled to first disk 40, and a second end 52 coupled to second disk 44. In one embodiment, coupling 46 is provided by a plurality of sets 54, 56, 58, 60, 62, 64 of resiliently deformable stretchable bands wrapped in parallel about axis 42. It is preferred that the bands be both functionally and geometrically in parallel about axis 42. Each set has a plurality of stretchable bands extending end-to-end in series and wrapped around intermediate disks, to be described. For example, set 54 has stretchable bands 66, 68, 70, 72 extending end-to-end in series, set 56 also has four stretchable bands extending end-to-end in series, and so on. The bands are connected to respective disks, to be described.

A plurality of intermediate disks 74, FIGS. 2, 3, 6, 7, are provided between disks 40 and 44. The intermediate disks include a first set of connection disks 76, 78, 80 axially spaced from each other and providing connection points for the ends of respective bands. For example, bands 68 and 70, FIG. 3, extend in series relation and are connected end-to-end in series connection at ends 82 and 84 at intermediate connection disk 78. The ends of the bands have apertures therethrough for mounting on respective studs such as 86 and 88, FIG. 6, of a respective disk such as 78, and are held thereon by an allen hex nut or the like such as 90 and 92. Other ends of respective bands are connected to respective disks in like manner. The noted intermediate disks also include a plurality of sets 94, 96, 98, 100 of spacer disks. Each set of spacer disks includes a plurality of disks such as 102, FIG. 7. The plurality of spacer disks 102 in set 94 are between disks 44 and 76. The plurality of spacer disks 102 in set 96 are between intermediate disks 76 and 78. The plurality of spacer disks 102 in set 98 are between intermediate disks 78 and 80. The plurality of spacer disks 102 in set 100 are between disks 80 and 40. For clarity, the spacer disks are not shown in FIG. 3, and in FIG. 2 are only shown in the broken away portion thereof. In band set 54, FIG. 2, the lower end of band 72 is connected to disk 40, and the upper end of band 66 is connected to disk 44. The upper end of band 72 is coupled to the lower end of band 66, either by direct connection thereto (in which case intermediate connection disk 78 and spacer disk sets 96 and 98 are eliminated), or by connection through an intermediate connection disk, or through one or more additional stretchable bands such as 70, 68 in combination with one or more intermediate connections disks. The intermediate disks 74 are axially aligned with and axially interposed between the noted first and second disks 40 and 44. The bands may be connected to respective disks as shown at a terminal end of a band, or alternatively the band may be looped around a respective connection such as 86 at any of disks 40, 44, 76, 78, 80 in serpentine manner, for example as shown at dashed line loop 103.

An adjustment mechanism 104, FIGS. 2, 5, is provided for adjustably controlling the position of disk 44 relative to the spiral to selectively increase or decrease spiral tension along coupling 46 to vary resistance to rotation of first disk 40, and hence vary the resistance to upward curling of training member arm 20 and handles 24, 26. Adjustment mechanism 104 adjustably controls the rotational position of disk 44 about axis 42. The adjustment mechanism includes a toothed gear 106 fixed to disk 44 and rotational therewith about axis 42, and an adjustment gear 108 rotational about a second axis 110 transverse to axis 42. Gear 106 is a toothed gear fixed to disk 44 by welding or by pins or bolts such as 112 or by a keyway such as 114. Gear 108 is a worm gear having spiral teeth 116 engaging teeth 118 of gear 106 to rotate toothed gear 106 and disk 44 about axis 42 to change the rotational position of disk 44 about axis 42 relative to disk 40. Worm gear 108 is mounted on a shaft 120, FIG. 1, supported on the frame, and may have an adjustment knob or dial face 122 with calibration or scale indicia. Disk 44 has a fixed, or at least resistive, rotational position about axis 42 relative to disk 40. The adjustment mechanism adjustably controls the fixed or resistive rotational position of disk 44 about axis 42 to vary resistance to rotation of disk 40.

PRESENT APPLICATION

FIG. 8 shows a rowing exercise machine in accordance with the present invention, and uses like reference numerals from above where appropriate to facilitate understanding. Rowing exercise machine 130 includes a track 132 supported on front and rear support legs 134, 136 and having a user seat 138 movable therealong as shown at directional arrow 140. Resistance mechanism 12 is provided as above described and includes first disk 40 rotational about axis 42, second disk 44 axially aligned with first disk 40 and resisting rotation about axis 42, and resiliently deformable coupling 46 coupled between disks 40 and 44 and tensionable in a spiral about axis 42, such that rotation of first disk 40 about axis 42 tensions and stretches coupling 46 along the noted spiral and is resisted by second disk 44, all as above described. A user handle 142 is coupled through pull cable 144 and a second coupling 146 to first disk 40 to resist movement of handle 142 rightwardly in FIG. 8 and concordant movement of user 148 on seat 138 along track 132. Stationary footpads 150, 152 at the front of the track are engaged by the feet of the user during the rowing exercise.

In the preferred embodiment, the direction of movement 140 of seat 138 along track 132 is normal to axis 42. Second coupling 146 includes pull cable 144, and handle 142 is movable by pulling cable 144 rightwardly in FIG. 8 to rotate first disk 40 through second coupling 146. A spool 154 is rotational about a second axis 156 and is coupled to disk 40 in driving relation, such that rotation of spool 154 about axis 156 rotates disk 40 about axis 42. Pull cable 144 is wound around spool 154. Axis 156 is parallel to axis 42, and handle 142 is movable by pulling cable 144 along direction 140 normal to first and second axes 42 and 156. Spool 154 is preferably coupled to disk 40 in geared relation, and further preferably in gear reduction relation. Spool 154 has a driving gear 158 thereon, and disk 40 has a driven gear 160 thereon driven by driving gear 158. Driven gear 160 is larger than drive gear 158 such that a given angular rotation of drive gear 158 corresponds to a lesser angular rotation of driven gear 160.

Adjustment mechanism 104 adjustably controls the position of second disk 44 relative to the noted spiral to selectively increase or decrease spiral tension along coupling 46 to vary resistance to rotation of first disk 40, as above described. This varies the resistance to rotational movement of spool 154 of second coupling 146 and translational movement of handle 142 and concordant movement of user 148 on seat 138 along track 132. Adjustment mechanism 104 adjustably controls the rotational position of second disk 44 about axis 42. The adjustment mechanism includes toothed gear 106, as above, fixed to second disk 44 and rotational therewith about axis 42, and an adjustment gear 108, as above, rotational about axis 110 and having gear teeth 116, FIG. 5, engaging the teeth 118 of toothed gear 106 to rotate toothed gear 106 and second disk 44 about axis 42 to change the rotational position of second disk 44 about axis 42 relative to first disk 40. As above, adjustment gear 108 is a worm gear rotational about axis 110. Axis 110 is transverse to axis 42. Worm gear 108 has spiral gear teeth 116, FIG. 5, engaging the teeth 118 of toothed gear 106 to rotate toothed gear 106 and second disk 44 about axis 42. Worm gear 108 on shaft 120 has an adjustment knob or dial face 122 with calibration or scale indicia. Disk 44 has a fixed, or at least resistive, rotational position about axis 42 relative to disk 40. The adjustment mechanism adjustably controls the fixed or resistive rotational position of disk 44 about axis 42 to vary resistance to rotation of disk 40. The adjustment mechanism adjustably controls the resistive rotational position of second disk 44 about axis 42 to selectively increase or decrease spiral tension along first coupling 46 to vary resistance to rotation of first disk 40 and rotational movement of second coupling 146 and translational movement of handle 142 and concordant movement of user 148 on seat 138 along track 132. The noted adjustment may be done manually via knob 122, or alternatively or additionally a software based system may be used to automatically change resistance and allow use of various training programs.

It is recognized that various equivalents, alternatives and modifications are possible within the scope of the appended claims.

What is claimed is:

1. A rowing exercise machine comprising a track having a user seat movable therealong, a resistance mechanism comprising a first disk rotational about an axis, a second disk axially aligned with said first disk and resisting rotation about said axis, a first coupling coupled between said first and second disks, said first coupling being resiliently deformable and being tensionable in a spiral about said axis upon rotation of said first disk about said axis such that rotation of said first disk about said axis tensions and stretches said first coupling along said spiral and is resisted by said second disk, a user handle coupled to said first disk by a second coupling to resist movement of said handle and concordant movement of the user on said seat along said track.

2. The rowing exercise machine according to claim 1 wherein the direction of movement of said seat along said track is normal to said axis.

3. The rowing exercise machine according to claim 1 wherein said second coupling is a pull cable, and said handle is moveable by pulling said cable to rotate said first disk through said second coupling.

4. The rowing exercise machine according to claim 3 wherein said resistance mechanism comprises a spool rotational about a second axis and coupled to said first disk in driving relation, such that rotation of said spool about said second axis rotates said first disk about said first mentioned axis, and wherein said pull cable is wound around said spool.

5. The rowing exercise machine according to claim 4 wherein said second axis is parallel to said first axis, and said handle is movable by pulling said cable along a direction normal to said first and second axes.

6. The rowing exercise machine according to claim 4 wherein said spool is coupled to said first disk in geared relation.

7. The rowing exercise machine according to claim 6 wherein said spool is coupled to said first disk in gear reduction relation, said spool having a driving gear thereon, said first disk having a driven gear thereon driven by said driving gear, said driven gear being the larger than said drive gear such that a given angular rotation of said drive gear corresponds to a lesser angular rotation of said driven gear.

8. The rowing exercise machine according to claim 1 comprising an adjustment mechanism adjustably controlling the position of said second disk relative to said spiral to selectively increase or decrease spiral tension along said first coupling to vary resistance to rotation of said first disk and movement of said second coupling and said handle and concordant movement of the user on said seat along said track.

9. The rowing exercise machine according to claim 8 wherein said adjustment mechanism adjustably controls the rotational position of said second disk about said axis.

10. The rowing exercise machine according to claim 9 wherein said adjustment mechanism comprises a toothed gear fixed to said second disk and rotational therewith about said axis, and an adjustment gear rotational about a second axis and having gear teeth engaging the teeth of said toothed gear to rotate said toothed gear and said second disk about said first mentioned axis to change the rotational position of said second disk about said first axis relative to said first disk.

11. The rowing exercise machine according to claim 10 wherein said adjustment gear is a worm gear rotational about said second axis, wherein said second axis is transverse to said first axis, and said worm gear has spiral gear teeth engaging said teeth of said toothed gear to rotate said toothed gear and said second disk about said first axis.

12. The rowing exercise machine according to claim 1 wherein said second disk has a resistive rotational position about said axis relative to said first disk.

13. The rowing exercise machine according to claim 12 wherein said resistive rotational position of said second disk is a fixed rotational position of said second disk about said axis relative to said first disk.

14. The rowing exercise machine according to claim 12 comprising an adjustment mechanism adjustably controlling said resistive rotational position of said second disk about said axis to selectively increase or decrease spiral tension along said coupling to vary resistance to rotation of said first disk and movement of said second coupling and said handle and concordant movement of the user on said seat along said track.

15. The rowing exercise machine according to claim 1 wherein said first coupling has a first end coupled to said first disk, and a second end coupled to said second disk.

16. The rowing exercise machine according to claim 15 wherein said first coupling comprises a plurality of stretchable bands.

17. The rowing exercise machine according to claim 16 wherein said bands are wrapped in parallel about said axis.

18. The rowing exercise machine according to claim 17 wherein said bands are functionally in parallel about said axis.

19. The rowing exercise machine according to claim 18 wherein said bands are also geometrically in parallel about said axis.

20. The rowing exercise machine according to claim 16 wherein said bands are wrapped in series about said axis.

21. The rowing exercise machine according to claim 16 wherein said bands comprise a first stretchable band having first and second ends, and a second stretchable band having first and second ends, said first end of said first band being connected to said first disk, said second end of said first band being connected to said first end of said second band, said second end of said second band being coupled to said second disk.

22. The rowing exercise machine according to claim 21 wherein said second end of said second band is coupled to said second disk through one or more additional stretchable bands spirally tensionable in series about said axis.

23. The rowing exercise machine according to claim 21 comprising at least one intermediate disk axially aligned with and axially interposed between said first and second disks.

24. The rowing exercise machine according to claim 23 wherein said at least one intermediate disk is a connection disk wherein said second end of said first band and said first end of said second band are each attached to said connection disk such that said connection disk provides the connection between said second end of said first band and said first end of said second band.

25. The rowing exercise machine according to claim 23 wherein said at least one intermediate disk comprises one or more spacer disks axially spacing said first and second disks.

26. The rowing exercise machine according to claim 21 comprising a plurality of intermediate disks axially aligned with and axially interposed between said first and second disks, said intermediate disks comprising at least one connection disk wherein said second end of said first band and said first end of said second band are each attached to said connection disk such that said connection disk provides the connection between said second end of said first band and said first end of said second band, and wherein said intermediate disks comprise a first set of one or more spacer disks axially spacing said connection disk and said first disk, and a second set of one or more spacer disks axially spacing said connection disk and said second disk.

27. The rowing exercise machine according to claim 1 wherein said first coupling is looped around a connection at least one of said first and second disks.

28. The rowing exercise machine according to claim 1 comprising one or more intermediate disks axially aligned with and axially interposed between said first and second disks.

29. The rowing exercise machine according to claim 28 wherein said one or more intermediate disks comprise one or more connection disks to which said first coupling is coupled and tensioned along said spiral.

30. The rowing exercise machine according to claim 29 wherein said first coupling is connected to at least one of said first disk, said second disk, and said connection disk.

31. The rowing exercise machine according to claim 30 wherein said first coupling is connected to each of said first disk, said second disk, and said connection disk.

32. The rowing exercise machine according to claim 29 wherein said first coupling is looped around a connection at least one of said first disk, said second disk, and said connection disk.

33. The rowing exercise machine according to claim 28 wherein said one or more intermediate disks comprise spacer disks axially spacing said first and second disks.

34. The rowing exercise machine according to claim 28 wherein said one or more intermediate disks comprise a set of one or more connection disks to which said first coupling is coupled and tensioned along said spiral, a first set of one or more spacer disks axially spacing a respective said connection disk and said first disk, and a second set of one or more spacer disks axially spacing said respective connection disk and said second disk.

35. The rowing exercise machine according to claim 4 wherein said first and second disks are on a first shaft extending along said first rotational axis, said spool is on a second shaft extending along said second rotational axis, said first and second shafts being parallel to each other.

* * * * *